United States Patent [19]

Miyauchi et al.

[11] Patent Number: 4,517,158

[45] Date of Patent: May 14, 1985

[54] ALLOY WITH CONSTANT MODULUS OF ELASTICITY

[75] Inventors: Masami Miyauchi, Yokohama; Masayuki Itoh, Kawasaki, both of Japan

[73] Assignee: Tokyo Shibaura Denki Kabushiki Kaisha, Kawasaki, Japan

[21] Appl. No.: 578,702

[22] Filed: Feb. 9, 1984

[30] Foreign Application Priority Data

Mar. 31, 1983 [JP] Japan ..... 58-53555
Mar. 31, 1983 [JP] Japan ..... 58-53570

[51] Int. Cl.[3] ..... C22C 30/00

[52] U.S. Cl. ..... 420/584; 75/124; 75/128 Z; 75/128 T

[58] Field of Search ..... 75/124 F, 128 Z, 128 T; 420/584; 148/419, 442

[56] References Cited

U.S. PATENT DOCUMENTS

| | | | |
|---|---|---|---|
| 3,117,862 | 1/1964 | Clark | 75/124 |
| 3,971,677 | 7/1976 | Mason et al. | 148/31 |
| 4,066,447 | 1/1978 | Smith, Jr. et al. | 420/586 |
| 4,200,459 | 4/1980 | Smith, Jr. et al. | 420/447 |
| 4,377,553 | 3/1983 | Korenko | 75/124 F |

FOREIGN PATENT DOCUMENTS

| | | | |
|---|---|---|---|
| 3012673 | 10/1980 | Fed. Rep. of Germany | 75/123 K |
| 563419 | 12/1923 | France | 75/128 W |
| 838504 | 3/1939 | France | 75/128 W |
| 867163 | 10/1941 | France | 75/128 W |
| 46-9546 | 3/1971 | Japan | 75/124 F |
| 131155 | 10/1980 | Japan | 420/584 |

*Primary Examiner*—M. J. Andrews
*Assistant Examiner*—Debbie Yee
*Attorney, Agent, or Firm*—Oblon, Fisher, Spivak, McClelland & Maier

[57] ABSTRACT

This invention provides a CME alloy of Fe-Ni-Cr-Ti-Al-Zr and one of Fe-Ni-Co-Cr-Ti-Al-Zr. The former CME alloy comprises from 40 to 44.5% by wt of Ni, from 4 to 6.5% by wt of chromium, from 0.5 to 1.9% by wt of Ti, from 0.1 to 1% by wt of Al and from 0.2 to 2% by wt of Zr. The latter CME alloy comprises from 30 to 44.5% by wt Ni and from 0.4 and 15% by wt of Co, and the same amounts of the other metals as in the former CME alloy. A CME alloy comprising the components having the above-defined concentrations has an upper temperature limit greater than 130° C., at which temperature level its CME properties can be retained. The subject CME alloy also has great mechanical strength. This mechanical strength is more greatly improved by the addition of from 0.1 to 5.5% by wt of one or more elements selected from the group consisting of Mo, Nb, Ta and W.

8 Claims, 1 Drawing Figure

ALLOY WITH CONSTANT MODULUS OF ELASTICITY

BACKGROUND OF THE INVENTION

This invention relates to an alloy with constant modulus of elasticity (hereinafter referred to as "a CME alloy") which is used with, e.g., a precision instrument; and, more particularly, to a CME alloy which possesses characteristics whereby modulus of elasticity is constant, even within a high temperature range, having great mechanical strength.

The CME alloy has a CME characteristics whereby modulus of elasticity has a prominently small dependency on a temperature falling within a range peculiar to said alloy. The CME alloy is generally used with mechanical members whose modulus of elasticity should be sustained (without variation) when the ambient temperature varies, e.g., with precision parts of, for example, a torque indicator and time-measuring spring; precision structures involved in, e.g., precision bellows, an absolute manometer, a flow meter, an industrial manometer and Bourdon's tube; and vibrators included in, e.g., a tuning fork and oscillator.

Hitherto, an Fe-Ni alloy (elinvar) has been widely accepted as the CME alloy. However, this type of CME alloy has certain drawbacks, in that said alloy has to be applied in the cold worked form, and the conditions of cold working have adversely affected the CME properties and mechanical features, thereby obstructing the practical application of such CME alloy.

Therefore, there has been a recent trend toward the application of a precipitation hardening type CME alloy of Fe-Ni-Cr-Ti-Al. If the cold working conditions and heat treating conditions are properly selected, this precipitation type CME alloy can have its thermal elasticity coefficient (abbreviated as "TEC") easily reduced to zero, or to a value approximating zero. Further, said precipitation type CME alloy has great mechanical strength.

However, the upper limit of the temperature range within which said precipitation-type CME alloy can sustain its CME characteristics generally stands at from 70° to 80° C. On the whole, the ambient temperature of various sensors used with, e.g., an airplane, automobile or industrial plant sometimes rises above 80° C. Consequently, in the above-mentioned applications, a manometer involving bellows or a diaphragm prepared from such a precipitation-type CME alloy has a certain drawback, in that it fails to carry out reliable pressure detection within the temperature range in which said manometer is applied.

SUMMARY OF THE INVENTION

Accordingly, a primary object of the present invention is to provide a CME alloy whose CME properties may be sustained, even at a temperature above 130° C.

Another object of this invention is to provide a CME alloy which has a sufficient mechanical strength to avoid problems which might otherwise be encountered in its practical application.

To attain the above-mentioned objects, this invention provides a CME alloy which characteristically contains from 40 to 44.5% by wt of nickel (Ni), from 4.0 to 6.5% by wt of chromium (Cr), from 0.5 to 1.9% by wt of titanium (Ti), from 0.1 to 1.0% by wt of aluminium (Al), from 0.2 to 2.0% by wt of zirconium (Zr), as well as iron (Fe) and unavoidable impurities.

This invention is further intended to provide a CME alloy which characteristically contains from 30 to 44.5% by wt of nickel, from 0.4 to 15% by wt of cobalt (Co), from 4 to 6.5% by wt of chromium, from 0.5 to 1.9% by wt of titanium, from 0.1 to 1% by wt of aluminium, from 0.2 to 2% by wt of zirconium, as well as iron and unavoidable impurities.

The conventional precipitation-type CME alloy of Fe-Ni-Cr-Ti-Al has the required mechanical strength, due to the precipitation of intermetallic compounds containing Ni, Ti and Al. However, this CME alloy still has a drawback, in that, though the presence of Ti helps to elevate the mechanical strength of said CME alloy, yet the upper temperature limit at which the alloy can preserve its CME properties (hereinafter referred to simply as the "upper temperature limit") drops. By way of contrast, the CME alloy embodying this invention is characterized in that a decline in the upper temperature limit is prevented, by reducing the Ti content to 1.9% by wt; and the insufficient mechanical strength of the subject CME alloy, resulting from a decrease in the Ti content, is fully compensated for by the addition of Zr. When Zr is added, the synergetic effect of Zr and the low Ti and Al content elevates the mechanical strength of the subject CME alloy. Moreover, if Zr is contained in a smaller amount than prescribed, the upper temperature limit may be prevented from falling. Therefore, this invention can provide a mechanically strong CME alloy whose upper temperature limit is higher than 130° C.

DETAILED DESCRIPTION OF THE PREFERRED EMBODIMENT

Figure 1:
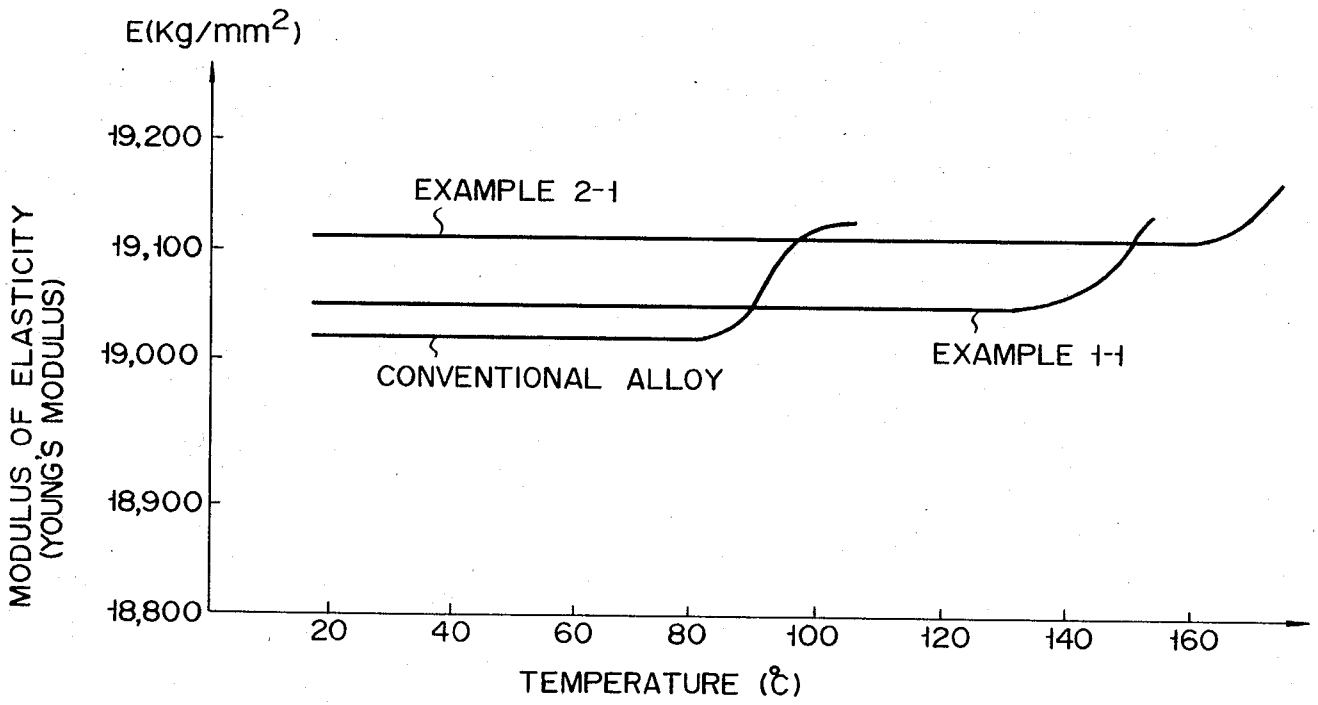
FIG. 1 graphically shows temperature changes, with respect to modulus of elasticity (Young's modulus) E as observed in the CME alloy of this invention, as well as in the conventional CME alloy.

The CME alloy according to this invention contains from 40 to 44.5% by wt of Ni, from 4 to 6.5% by wt of Cr, from 0.5 to 1.9% by wt of Ti, from 0.1 to 1% by wt of Al, from 0.2 to 2% by wt of Zr, with the remainder being substantially comprised of Fe. (This alloy is hereinafter referred to as an "Fe-Ni-Zr alloy".) In cases where Co is added, the subject CME alloy is so chosen as to contain from 30 to 44.5% by wt of Ni, from 0.4 to 15% by wt of Co, from 4 to 6.5% by wt of Cr, from 0.5 to 1.9% by wt of Ti, from 0.1 to 1% by wt of Al and from 0.2 to 2% by wt of Zr. (This Co-containing alloy is hereinafter referred to as an "Fe-Ni-Co-Zr alloy".) It is possible to add from 0.1 to 5.5% by wt of one or more elements selected from the group consisting of molybdenum (Mo), niobium (Nb), tantalum (Ta) and tungsten (W) with the above-mentioned Fe-Ni-Zr alloy and Fe-Ni-Co-Zr alloy.

The reason why the CME alloy according to this invention contains the above-listed components and the contents of said components are limited to the amounts provided opposite thereto may be explained as follows.

Reference is first made to the Fe-Ni-Zr alloy. Ni is an element which very effectively helps this alloy to demonstrate the CME properties; viz., to demonstrate the characteristic whereby the modulus of elasticity remains constant, regardless of temperature changes, or varies only to an extremely small extent with the temperature. Ni further acts to elevate the upper temperature limit of said alloy. The above-mentioned satisfactory effect of Ni in improving the CME properties is assured to prevail while the Ni content ranges from between 40 to 44.5% by wt. If the Ni content falls below 40% by wt or rises above 44.5% by wt, the Ni fails to ensure the effective properties of the CME alloy.

Like Ni, Cr acts to promote the CME properties of the subject CME alloy. Further, the addition of Cr increases the corrosion resistance of said alloy. The Cr content is set within a range of 4 to 6.5% by wt, since a Cr content lower than 4% by wt or higher than 6.5% by wt fails to ensure the required CME properties of said CME alloy.

When a CME alloy containing Ti is heat treated for aging, said Ti component is precipitated, to elevate the mechanical strength of said CME alloy. However, where, the Ti content is less than 0.5% by wt, it fails to fully elevate the mechanical strength of said CME alloy. Conversely, when the Ti content rises above 1.9% by wt, the CME properties of the CME alloy are deteriorated, leading to a drop in the upper temperature limit. Therefore, the Ti content is set within a range of from 0.5 to 1.9% by wt.

Like Ti, Al is another element effective in increasing the mechanical strength of the CME alloy. However, where the Al content is less than 0.1% by wt, it is insufficient to fully elevate the mechanical strength of the CME alloy; though an Al content greater than 1% by wt leads to a deterioration of the CME properties, resulting in a decline in its upper temperature limit. Therefore, the Al content is so set as to range from 0.1 to 1% by wt.

When contained in the subject CME alloy, together with Ti and Al, Zr might also serve to increase the mechanical strength of the CME alloy. Zr forms an intermetallic compound with one or more of the group consisting of Ni, Ti and Al, which exist within said CME alloy. The precipitation of the intermetallic compound helps to increase the mechanical strength of the CME alloy. If, in this case, the addition of Ti is neglected; though Zr is added therein, the CME alloy cannot sustain an increase in mechanical strength. In other words, the synergetic effect of Ti and Zr improves the mechanical strength of the CME alloy. Further, the substitution of Zr for part of the Ti content elevates the mechanical strength of the CME alloy, to the same extent as or to a higher extent than in cases wherein only Ti is added.

Mo, Nb, Ta and W improve the mechanical characteristics (strength, toughness, etc.) of the CME alloy, without causing its CME properties to deteriorate. In this case, it is advisable to select one or more of the group consisting of Mo, Nb, Ta and W, and to set the overall content of said components of the CME alloy within a range of from 0.1 to 5.5% by wt. The reason for this is that an overall content higher than this specified range fails to increase the mechanical strength or causes to deteriorate the CME properties of the CME alloy.

A description may now be made of a CME alloy of Fe-Ni-Co-Zr. Like Ni, Co acts to elevate the CME properties of this CME alloy. Co, in particular, has the effect of raising the magnetic transformation point (Curie temperature) of the CME alloy, and also helps to increase the previously defined upper temperature limit. In this case, the Co content is set within a range of from 0.5 to 15% by wt. A Co content lower than 0.5% by wt or higher than 15% by wt can scarcely raise the upper temperature limit. The Ni and Co components of the aforementioned Fe-Ni-Co-Zr CMe alloy are effective in raising its upper temperature limit. If the Ni content is higher than 30% by wt, the required upper temperature limit (i.e., a temperature higher than 130° C.) may be ensured. Therefore, it is advisable to set Ni content within a range of from 30 to 44.5% by wt.

The addition of the other components, such as Cr, Ti, Al, Zr, Mo, Nb, Ta and W, and the selection of their concentrations are defined, for the same reason given with respect to the Fe-N-Zr CME alloy.

A description may now be made of a method of manufacturing the CME alloy embodying this invention. The CME alloy containing the prescribed concentrations of the required components is melted, for example, in an induction melting furnace, either in a vacuum or in an inert gaseous atmosphere. Later, the ingot obtained by solidifying the molten alloy is hot worked into a prescribed form. After being cold worked, the shaped material is heat treated for aging, to manufacture a required CME alloy. The above-mentioned cold working process is carried out to such an extent that the cross-section of a worked material bears a ratio of from 10 to 90%, with respect to that of the original material before cold working. Aging is performed at a temperature of from 200° to 750° C., for from 0.1 to 100 hours.

Some examples of the invention may be described as follows, in conjunction with comparative examples (CME alloys falling outside of the scope of the CME alloy of the invention) and the conventional CME alloy.

TABLE 1

| | | Composition (% by wt.) | | | | | | | | | Upper temperature limit (°C.) | Tensile strength (kgf/mm²) |
|---|---|---|---|---|---|---|---|---|---|---|---|---|
| | | Ni | Cr | Ti | Al | Zr | Mo | Nb | Ta | W | | |
| Example | 1-1 | 42.7 | 5.5 | 1.1 | 0.4 | 0.5 | — | — | — | — | 135 | 115 |
| | 1-2 | 42.6 | 5.4 | 0.6 | 0.5 | 1.0 | — | — | — | — | 145 | 110 |
| | 1-3 | 42.8 | 5.6 | 1.2 | 0.1 | 0.5 | — | — | — | — | 135 | 110 |
| | 1-4 | 42.7 | 5.5 | 0.5 | 0.3 | 2.0 | — | — | — | — | 145 | 125 |
| | 1-5 | 42.5 | 5.4 | 1.0 | 0.4 | 0.5 | 0.5 | — | — | — | 140 | 130 |
| | 1-6 | 42.7 | 5.6 | 0.7 | 0.6 | 0.7 | 0.5 | 0.5 | — | — | 135 | 135 |
| | 1-7 | 42.8 | 5.2 | 0.6 | 0.5 | 0.6 | 1.5 | — | 0.5 | — | 130 | 140 |
| | 1-8 | 42.7 | 5.4 | 0.5 | 0.4 | 0.5 | 2.2 | — | — | 0.5 | 130 | 145 |
| | 1-9 | 42.6 | 5.5 | 0.5 | 0.4 | 0.6 | — | 2.7 | 2.0 | — | 130 | 150 |
| | 1-10 | 41.6 | 5.5 | 1.0 | 0.5 | 0.4 | — | — | — | — | 138 | 113 |
| | 1-11 | 43.7 | 5.4 | 1.1 | 0.4 | 0.5 | — | — | — | — | 132 | 119 |
| | 1-12 | 42.7 | 4.6 | 1.2 | 0.4 | 0.4 | — | — | — | — | 143 | 111 |
| | 1-13 | 42.6 | 6.1 | 1.1 | 0.6 | 0.5 | — | — | — | — | 132 | 118 |
| | 1-14 | 42.8 | 5.6 | 1.4 | 0.6 | 1.1 | — | — | — | — | 133 | 113 |

TABLE 1-continued

| | | Composition (% by wt.) | | | | | | | | | Upper temperature limit (°C.) | Tensile strength (kgf/mm²) |
|---|---|---|---|---|---|---|---|---|---|---|---|---|
| | | Ni | Cr | Ti | Al | Zr | Mo | Nb | Ta | W | | |
| | 1-15 | 42.6 | 5.5 | 1.8 | 0.4 | 1.0 | — | — | — | — | 130 | 116 |
| | 1-16 | 42.6 | 5.5 | 0.6 | 0.3 | 0.4 | — | — | — | — | 152 | 111 |
| | 1-17 | 42.5 | 5.6 | 0.5 | 0.2 | 1.0 | — | — | — | — | 148 | 115 |
| Comparative Example | 1-1 | 42.8 | 5.5 | 2.3 | 0.8 | 1.7 | — | — | — | — | 70 | 130 |
| | 1-2 | 42.7 | 5.3 | 0.5 | 0.4 | 0.1 | — | — | — | — | 135 | 100 |
| | 1-3 | 42.5 | 5.5 | 1.8 | 0.5 | 0.6 | — | — | 2.8 | 3.0 | 55 | 155 |
| Conventional alloy | | 42.2 | 5.5 | 2.5 | 0.7 | — | — | — | — | — | 80 | 110 |

TABLE 2

| | | Composition (% by wt) | | | | | | | | | | Upper temperature limit (°C.) | Tensile strength (kgf/mm²) |
|---|---|---|---|---|---|---|---|---|---|---|---|---|---|
| | | Ni | Co | Cr | Ti | Al | Zr | Mo | Nb | Ta | W | | |
| Example | 2-1 | 39.1 | 5.3 | 5.2 | 0.8 | 0.5 | 0.6 | — | — | — | — | 165 | 115 |
| | 2-2 | 38.7 | 5.5 | 5.4 | 0.9 | 0.5 | 2.0 | — | — | — | — | 140 | 130 |
| | 2-3 | 41.6 | 2.3 | 5.5 | 0.6 | 0.8 | 1.1 | — | — | — | — | 150 | 130 |
| | 2-4 | 35.1 | 14.8 | 5.2 | 0.6 | 0.7 | 0.9 | — | — | — | — | 145 | 135 |
| | 2-5 | 38.9 | 5.4 | 5.4 | 0.7 | 0.6 | 0.9 | 0.5 | — | — | — | 140 | 140 |
| | 2-6 | 38.7 | 5.5 | 5.3 | 0.7 | 0.5 | 0.9 | 0.5 | 0.5 | — | — | 135 | 145 |
| | 2-7 | 39.1 | 5.4 | 5.4 | 0.6 | 0.5 | 0.8 | 1.5 | — | 0.5 | — | 135 | 150 |
| | 2-8 | 39.2 | 5.2 | 5.3 | 0.6 | 0.4 | 0.3 | — | 3.1 | — | 2.2 | 130 | 155 |
| | 2-9 | 39.0 | 5.4 | 4.6 | 0.9 | 0.4 | 0.6 | — | — | — | — | 172 | 113 |
| | 2-10 | 38.8 | 5.5 | 6.0 | 0.9 | 0.5 | 0.5 | — | — | — | — | 159 | 119 |
| | 2-11 | 38.8 | 5.5 | 5.4 | 1.0 | 0.6 | 0.4 | — | — | — | — | 152 | 116 |
| | 2-12 | 38.9 | 5.6 | 5.3 | 0.9 | 0.5 | 1.0 | — | — | — | — | 148 | 120 |
| | 2-13 | 39.0 | 5.5 | 5.3 | 1.3 | 0.4 | 0.5 | — | — | — | — | 156 | 117 |
| | 2-14 | 39.1 | 5.4 | 5.3 | 1.8 | 0.5 | 0.6 | — | — | — | — | 150 | 121 |
| | 2-15 | 38.3 | 8.5 | 5.4 | 0.5 | 0.7 | 1.0 | — | — | — | — | 147 | 133 |
| Comparative Example | 2-1 | 38.5 | 5.2 | 5.5 | 2.2 | 1.0 | 1.3 | — | — | — | — | 75 | 120 |
| | 2-2 | 39.1 | 5.3 | 5.4 | 1.2 | 0.6 | 0.1 | — | — | — | — | 120 | 105 |
| | 2-3 | 39.1 | 5.2 | 5.2 | 0.7 | 0.5 | 0.6 | — | — | 3.0 | 2.9 | 70 | 150 |
| Conventional alloy | | 42.2 | — | 5.5 | 2.5 | 0.7 | — | — | — | — | — | 80 | 110 |

Table 1 includes data on the Fe-Ni-Zr CME alloy, and Table 2 gives data on the Fe-Ni-Co-Zr CME alloy. Examples 1-1 to 1-17, as shown in Table 1; and examples 2-1 to 2-15, as set forth in Table 2, are related to the Fe-Ni-Zr CME alloy and Fe-Ni-Co-Zr CME alloy whose components are contained in the concentrations specified by this invention. Comparative Example 1-1 to 1-3, as given in Table 1; and Comparative Examples 2-1 to 2-3, as shown in Table 2, represent CME alloys having compositions falling beyond the range of those defined by the invention. The conventional CME alloys indicated in Table 1 and Table 2 are precipitation hardening type alloys which lack Zr. Each of these alloys indicated in Table 1 and Table 2 includes the balance of Fe.

The CME alloys listed in Table 1 and Table 2 were manufactured by high frequency vacuum melting. The manufactured ingot was made into a plate having a thickness of 2 mm, by hot working. The plate was held at a temperature of 1,000° C. for one hour, and was then dipped into water for quenching. Thereafter, the plate was cold worked at a work ratio of 50%, to provide a strip having a thickness of 1 mm. The tensile strength and CME properties of the strip were measured after it was heat treated for aging.

The CME properties were evaluated by the upper temperature limit of the temperature range within which the thermal elasticity coefficient TEC falls within a range from $-20\times10^{-6}$ to $20\times10^{-6}$ (1/°C.). A test piece, which was 1 mm thick, 10 mm wide and 100 mm long, was cut out of the strip. Measurement was made of the proper vibration of the test piece, by the crosswise vibration method, at various temperature levels. The modulus of elasticity (Young's modulus) E of the test piece was determined from the data obtained by the measurement of said proper vibration. Assuming that $\epsilon$ represents change in the modulus of elasticity E with respect to the temperature change of the test piece, and $\alpha$ denotes change in the linear expansion coefficient with respect to the temperature change of said test piece, the thermal elasticity coefficient TEC may expressed as $\epsilon+\alpha$. The temperature range within which said TEC stands at $\pm20\times10^{-6}$ (1/°C.), with respect to the value indicated by said TEC at room temperature (20° C.), is regarded as the temperature range within which the CME properties are ensured. Table 1 and Table 2 set forth the above-defined upper temperature limit of the temperature range. The tensile strengths of the test pieces are also given in Table 1 and Table 2.

FIG. 1 shows the Young's modulus E of Example 1-1 (with a CME alloy of Fe-Ni-Zr), Example 2-1 (with a CME alloy of Fe-Ni-Co-Zr) and a conventional CME alloy with respect to the temperature change. When an ambient temperature rises above 80° C., the Young's modulus E of the conventional CME alloy suddenly increases, preventing the CME properties of said alloy from being exhibited. By way of contrast, the CME alloy of Example 1-1 has a substantially stable Young's modulus E, over a temperature range of from room temperature (20° C.) to 130° C.; and an extremely small thermal elasticity coefficient TEC, such as $8\times10^{-6}$ (1/°C.). The CME alloy of Example 2-1 (containing Co) has a very minute thermal elasticity coefficient TEC such as $5\times10^{-6}$ (1/°C.). Thus, as may be seen from Table 1 and Table 2, the conventional CME alloy has an upper temperature limit of 80° C., where as the CME alloys of Examples 1-1 and 2-1 respectively have upper temperature limits of 135° C. and 165° C.

Table 1 and Table 2 show that the CME alloy of the Comparative Example 1-1 which contains as much as 2.3% by wt of Ti has an upper temperature limit as low as 70° C. The control alloy 1-3 which contains as large an amount of Ta+W as 5.8% by wt has an upper temperature limit as low as 55° C. The CME alloy of the Comparative Example 1-2 which contains as small an amount of Zr as 0.1% by wt reduces the mechanical strength of the resultant CME alloy.

The CME alloy of the Comparative Example 2-1 which contains as large an amount of Ti as 2.2% by wt has an upper temperature limit as low as 75° C. Also, the CME alloy of the Comparative Example alloy 2-3 which contains as large an amount of Ta+W as 5.9% by wt has an upper temperature limit as low as 70° C. The CME alloy of Comparative Example 2-2 which contains as small an amount of Zr as 0.1% by wt loses its mechanical strength.

By way of contrast, the various CME alloys of Examples 1-1 to 1-17 and Examples 2-1 to 2-15 have an upper temperature limit higher than 130° C., and a tensile strength the same as or higher than the conventional CME alloy, viz. a sufficiently great mechanical strength for practical applications. The CME alloys of Examples 1-5 to 1-9 and Examples 2-5 to 2-8, which contains the prescribed amounts of Mo, Nb, Ta and W, are even more greatly improved in tensile strength.

What is claimed is:

1. An alloy with constant modulus of elasticity consisting essentially of from 40 to 44.5% by wt of nickel, from 4 to 6.5% by wt of chromium, from 0.5 to 1.9% by wt of titanium, from 0.1 to 1% by wt of aluminium, and from 0.2 to 2% by wt of zirconium, with the remainder being comprised of iron.

2. The alloy according to claim 1, which further consists essentially of from 0.1 to 5.5% by wt of one or more elements selected from the group consisting of molybdenum, niobium, tantalum and tungsten.

3. An alloy with constant modulus of elasticity consisting essentially of from 30 to 44.5% by wt of nickel, from 0.4 to 15% by wt of cobalt, from 4 to 6.5% by wt of chromium, from 0.5 to 1.9% by wt titanium, from 0.1 to 1% by wt of aluminium, and from 0.2 to 2% by wt of zirconium, with the remainder being comprised of iron.

4. The alloy according to claim 3, which further consists essentially of from 0.1 to 5.5% by wt of one or more elements selected from the group consisting of molybdenum, niobium, tantalum and tungsten.

5. The alloy according to claim 1, wherein zirconium forms an intermetallic compound with at least one metal selected from the group consisting of nickel, titanium and aluminum thereby increasing the mechanical strength of the alloy.

6. The alloy according to claim 1, wherein a thermal elasticity coefficient of the alloy falls within a range of about $-20\times10^{-6}$ to $20\times10^{-6}$ (1/°C.) over temperatures ranging from about 20° C. to 130° C.

7. The alloy according to claim 3, wherein zirconium forms an intermetallic compound with at least one metal selected from the group consisting of nickel, titanium and aluminum thereby increasing the mechanical strength of the alloy.

8. The alloy according to claim 3, wherein a thermal elasticity coefficient of the alloy falls in a range from about $-20\times10^{-6}$ to $20\times10^{-6}$ (1/°C.) over temperatures ranging from about 20° C. to 130° C.

* * * * *